US008636855B2

(12) United States Patent
Wang et al.

(10) Patent No.: US 8,636,855 B2
(45) Date of Patent: Jan. 28, 2014

(54) METHODS OF ENHANCING MECHANICAL PROPERTIES OF ALUMINUM ALLOY HIGH PRESSURE DIE CASTINGS

(75) Inventors: Qigui Wang, Rochester Hills, MI (US); Wenying Yang, Windsor, CA (US)

(73) Assignee: GM Global Technology Operations LLC, Detroit, MI (US)

( * ) Notice: Subject to any disclaimer, the term of this patent is extended or adjusted under 35 U.S.C. 154(b) by 789 days.

(21) Appl. No.: 12/398,219

(22) Filed: Mar. 5, 2009

(65) Prior Publication Data

US 2010/0224289 A1 Sep. 9, 2010

(51) Int. Cl.
*C22F 1/04* (2006.01)

(52) U.S. Cl.
USPC ..... 148/549; 148/698; 148/699; 148/700; 148/701; 148/702

(58) Field of Classification Search
USPC ..... 148/698–702, 549
See application file for complete search history.

(56) References Cited

U.S. PATENT DOCUMENTS

2009/0038720 A1 2/2009 Lumley et al.

FOREIGN PATENT DOCUMENTS

| | | | |
|---|---|---|---|
| CN | 1834281 | A | 9/2006 |
| CN | 101193839 | A | 6/2008 |
| CN | 101525732 | A | 9/2009 |
| DE | 697 25 490 | T2 | 8/2004 |
| DE | 10 2006 057 660 | A1 | 6/2008 |
| EP | 0796926 | * | 9/1997 |

OTHER PUBLICATIONS

Kearney et al. "Aluminum Foundry Products." Properties and Selection: Nonferrous Alloys and Special Purpose Materials, vol. 2, ASM Handbook, ASM International, 1990, pp. 123-151.*

Lumley, R.N. et al., "Blister Free Heat Treatment of High Pressure Die-Casting Alloys", Materials Science Forum, vols. 519-521 (2006), pp. 351-358.

Lumley, R.N. et al., "The Development of Heat Treatment Procedures for Aluminum High Pressure Die-Castings", Proc 13th Die Casting Conference of the Australian Die Casting Association, Melbourne, Australia, 2006, p. 25.

Lumley, R.N. et al., "Heat Treatment of High-Pressure Die Castings", Metallurgical and Materials Transactions A, vol. 38A, Oct. 2007, pp. 2564-2574.

Shercliff, H. R., et al., A Process Model for Age Hardening of Aluminium Alloys-I. The Model, Acta Metall. Mater. vol. 38, No. 10, 1990, Great Britain, pp. 1789-1802.

(Continued)

*Primary Examiner* — Brian Walck
(74) *Attorney, Agent, or Firm* — Dinsmore & Shohl LLP

(57) ABSTRACT

Methods of enhancing mechanical properties of aluminum alloy high pressure die castings are disclosed herein. An aluminum alloy composition forming a casting comprises, by weight of the composition, at least one of a magnesium concentration greater than about 0.2%, a copper concentration greater than about 1.5%, a silicon concentration greater than about 0.5%, and a zinc concentration greater than about 0.3%. After solidification, a casting is cooled to a quenching temperature between about 300° C. and about 500° C. Upon attainment of the quenching temperature, the casting is removed from the die and immediately quenched in a quench media. Following quenching, the casting is pre-aged at a reduced temperature between about room temperature and about 100° C. Thereafter, the casting is aged via at least one substantially isothermal aging at one or more elevated temperatures between about 150° C. and about 240° C.

25 Claims, 8 Drawing Sheets

(56) References Cited

OTHER PUBLICATIONS

Lifshitz, I. M., et al. The Kinetics of Precipitation From Supersaturated Solid Solutions, J. Phys. Chem. Solids, Pergmon Press 1 961, vol. 19, Nos. 1/2, pp. 35-50, Great Britain.

Evancho, J.W., et al., Kinetics of Precipitation in Aluminum Alloys During Continuous Cooling, Metallurgical Transactions, vol. 5, Jan. 1974-43, Supplied by the British Library, pp. 1-5.

Wagner, Theory of the Aging of Precipitation by Umlosen, Bd. 65, Nr. 7/8, 1961, pp. 581-591.

* cited by examiner

METHODS OF ENHANCING MECHANICAL PROPERTIES OF ALUMINUM ALLOY HIGH PRESSURE DIE CASTINGS

BACKGROUND

Embodiments of the present invention relate generally to aluminum alloy high pressure die castings and particularly to methods of enhancing mechanical properties of aluminum alloy high pressure die castings and to methods of manufacturing aluminum alloy high pressure die castings in high pressure die casting and heat treatment processes.

High pressure die casting (HPDC) processes are widely used for mass production of metal components because of the processes' low cost and the close dimensional tolerances (near-net-shape) and smooth surface finishes they provide to the castings formed therefrom. For example, manufacturers in the car industry use HPDC to produce near-net-shape aluminum alloy castings for engine and, in particular, transmission applications.

One disadvantage of conventional HPDC processes, however, is that the HPDC castings generally are not amenable to solution treatment (T4) at high temperatures, such as about 500° C., for most high pressure die cast aluminum alloys. This significantly reduces the potential for precipitation hardening in the castings through a full T6 and/or T7 (=T4+T5, see detailed description below) heat treatment. The castings generally are not amenable to solution treatment (T4) due to a high quantity of porosity and voids in the components. The porosity and voids generally are attributable to shrinkage of the alloy from a low density liquid metal to a high density solid casting during solidification and, in particular, to gases, such as air, hydrogen or vapors formed from the decomposition of die wall lubricants, entrapped while filling the die with the molten metal. As such, virtually all HPDC castings have large gas bubbles formed therein. Further, internal pores containing gases or gas forming compounds within HPDC castings typically expand during conventional solution treatment at elevated temperatures, thereby, forming surface blisters on the castings. The presence of these blisters affects not only the appearance of castings, but the dimensional stability and, in particular, the mechanical properties of the castings as well.

Therefore, to avoid the potential for blister formation, conventional aluminum alloy HPDC castings generally are used in as-cast and/or, to a lesser extent, in aged conditions, such as T5. Even with subjecting HPDC castings to a conventional T5 aging, however, the increase of yield strength, and other mechanical properties, is still very limited, since, in conventional as-cast aluminum alloy high pressure die castings, the concentrations of solutes available for strengthening in artificial aging (T5) are very low due to slow cooling after solidification. Additionally, the conventional single step isothermal aging (T5) at an intermediate temperature in many cases cannot maximize the mechanical properties for given concentrations of solutes in the material prior to aging. As a result, the mechanical properties of the conventional HPDC castings are usually low for a given composition of the aluminum alloy in comparison with other casting processes since the aluminum alloy castings made by other casting processes generally may be heat treated in full T6 or T7 conditions.

Developed technologies, such as the use of vacuum to remove air in mold cavities during die filling, improve the quality of HPDC castings and their solution treat-ability. Use of these technologies, however, is still limited due to the high cost of facility and maintenance and operational complexity. Further, it also has been disclosed that blistering can be avoided, to a certain degree, by using much shorter solution treatment times and lower temperatures. For example, experiments with strengthening aluminum alloys 360 (Al-9.5Si-0.5Mg) and 380 (Al-8.5Si-3.5Cu) have shown that significant responses to aging are still possible following such modified solution treatments ([1] R. N. Lumley, R. G. O'Donnell, D. R. Gunasegaram, M. Givord, International Patent Application PCT/2005/001909; [2] R. N. Lumley, R. G. O'Donnell, D. R. Gunasegaram, M. Givord: Mat. Sci. Forum, 2006, vols. 519-522, pp. 351-359; [3] R. N. Lumley, R. G. O'Donnell, D. R. Gunasegaram, M. Givord: Proc 13th Die Casting Conference of the Australian Die Casting Association, Melbourne, Australia, 2006, P25; and [4] R. N. Lumley, R. G. O'Donnell, D. R. Gunasegaram, M. Givord, Metall Trans. 2008 in press). It appears, however, that these experiments are limited in value not only because the data disclosed merely are based on test specimens having very low porosity, but also because the solution (T4) heat treatment process parameter window is too narrow for highly complex HPDC castings.

Conventional T6 and/or T7 heat treatment processes for aluminum alloy castings normally involve following three stages: (1) solution treatment at a relatively high temperature below the melting point of the castings (also defined as T4), often for times exceeding 5 hours to dissolve its alloying (solute) elements and homogenize or modify the microstructure; (2) rapid cooling, or quenching, such as into cold or hot water, to retain the solute elements in a supersaturated solid solution; and (3) artificial aging (T5) by holding the casting for a period of time at an intermediate temperature suitable for achieving strengthening through precipitation. Solution treatment (T4) serves generally three main purposes: (1) dissolution of elements that lead to age hardening, (2) spherodization of un-dissolved particles and/or phases, and (3) homogenization of solute concentrations in the material. Quenching after T4 solution treatment retains the hardening solutes in a supersaturated solid solution (SSS) and creates a supersaturation of vacancies that enhances the diffusion and dispersion of precipitates. To maximize the yield strength, and other mechanical properties, of the casting, the precipitation of all strengthening phases should be prevented during quenching. Aging (T5, either natural or artificial) enables a controlled dispersion of strengthening precipitates. FIG. 1 shows a typical conventional T6 and/or T7 heat treatment cycle of an aluminum alloy.

With T5 aging (FIG. 1), there generally are three types of aging conditions, which are commonly referred as under-aging, peak-aging and over-aging. At an initial stage of aging, or pre-aging, Guinier-Preston (GP) zones and fine shearable precipitates form and the casting is considered to be under-aged. In this condition, mechanical properties of the casting usually are low. Increased time at a given temperature or aging at a higher temperature further evolves the precipitate structure and increases mechanical properties, such as yield strength, to a maximum levels to achieve the peak-aging/strength condition. Further aging decreases the mechanical properties and the casting becomes over-aged due to precipitate coarsening and its transformation of crystallographic incoherency. Simply for exemplary purposes, FIG. 2 shows an example of aging responses of cast aluminum alloys A356/357 manufactured under conventional sand casting processes and aged at a temperature of 170° C. For the period of aging time tested at a given aging temperature, the castings, whether sand castings or high pressure die castings referred to herein, undergo under-aged, peak-aged, and over-aged conditions.

Considering that conventional aluminum alloy HPDC castings generally inevitably contain internal porosity, artificial aging (T5) may be one of the ideal means (solutions) to help to achieve the desired mechanical properties in the castings without creating blisters. The strengthening resulting from aging occurs because the retained hardening solutes in the supersaturated solid solution form precipitates that are finely dispersed throughout the grains and that increase the ability of the casting to resist deformation by slip and plastic flow. Maximum strengthening may occur when the aging treatment leads to the formation of a critical dispersion of at least one type of these fine precipitates.

In addition, in conventional HPDC casting processes, the castings often are slowly cooled to a low temperature, such as below 200° C., prior to removal from the die to quench. This slow cooling to a low temperature significantly diminishes the subsequent aging potential of the casting since the hardening solute solubility decreases dramatically with the decrease in temperature, i.e., the lower the temperature, the lower the solubility. For example, the solubility of magnesium (Mg) in HPDC aluminum alloy A380 is about 0.34% at about 500° C. and decreases to nearly zero at about 200° C. Therefore, the conventional aluminum alloy high pressure die casting processes are ineffective in terms of energy consumption and achievable mechanical properties.

SUMMARY

It is against the above background that embodiments of the present invention generally relate to methods to enhance mechanical properties of high pressure die castings of an age strengthen-able aluminum alloy. One or more mechanical properties may be enhanced through a multi-aging process together with an immediate quench following removal of the casting from the die. The embodiments are applicable to all age strengthen-able, porous, or pore-free, aluminum alloy castings including HPDC aluminum castings.

According to the embodiments, the aluminum alloy composition for the HPDC process comprises aging hardening elements (solutes) that include at least one of magnesium (Mg), copper (Cu), silicon (Si), and zinc (Zn). Generally, the respective concentrations of Mg, Cu, Si, and Zn, when respectively incorporated into the composition, meet the following minimum requirements: a Mg concentration greater than about 0.2% by weight of the aluminum alloy composition; a Cu concentration greater than about 1.5% by weight of the aluminum alloy composition, a Si concentration greater than about 0.5% by weight of the aluminum alloy composition, and a Zn concentration greater than about 0.3% by weight of the aluminum alloy composition. In one particular embodiment, a composition comprises concentrations of Mg, Cu, Si, and Zn equal to about 0.35%, about 3.0%, about 9.0%, and 0.5%, respectively, by weight of the composition. The present inventors contemplate that a high concentration (e.g., between about 8% and about 13%) of Si may significantly enhance a cast-ability of the aluminum alloy composition. When Cu and Mg are present, Zn promotes attractive aging (including pre-aging) responses.

In the embodiments, the aluminum alloy HPDC castings are quenched immediately after the castings are solidified and cooled to a quenching temperature. The temperature at which the castings are removed from the dies and then rapidly quenched in a quench media, such as water, air, or organic additive solutions, generally depends on the given aluminum alloy compositions. For most aluminum alloy HPDC castings, the quenching temperatures generally are between about 300° C. and about 500° C., depending upon the actual alloy composition and, more particularly, between about 400° C. and about 450° C.

Following the quenching, the castings are aged to attain enhanced mechanical properties through a multi-aging process. The multi-aging process of the embodiments may include, but is not limited to, two agings. In the first aging, also referred to herein as pre-aging, the castings are aged at a reduced temperature in comparison with the subsequent aging(s). For instance, the pre-aging temperature generally does not exceed about 100° C. so as to allow the castings to be quenched, and, potentially, aged, in either warm or hot water or air after removal of the castings from the dies. The length of time for the pre-aging generally varies with the aging temperature and may be as long as several days or a couple of weeks when the castings are initially naturally aged at room temperature. The subsequent aging(s), also referred to herein as isothermal aging(s), is performed at a temperature elevated to the reduced temperature of the pre-aging. The present inventors contemplate that multiple isothermal agings may be preformed subsequent to the pre-aging to further enhance the mechanical properties of the castings.

FIG. 3 graphically illustrates a comparison between the conventional HPDC and T5 aging process and an embodiment involving an immediate quenching of the casting after removal from the die and a multi-step aging process. The present inventors contemplate that with completion of the embodiments, the yield strength of aluminum HPDC castings may be increased by 50% or greater in comparison with castings made in conventional HPDC and T5 aging processes.

In accordance with one embodiment, a method of enhancing a mechanical property of an aluminum alloy high pressure die casting comprises: forcing under high pressure a molten aluminum alloy composition into what is generally a metal die having one or more mold cavities, wherein the aluminum alloy composition comprises at least one of magnesium, copper and silicon; solidifying the aluminum alloy composition in the die to form the aluminum alloy high pressure die casting; cooling the casting in the die to a quenching temperature between about 300° C. and about 500° C.; quenching the casting in a quench media immediately upon attainment of the quenching temperature of the casting; pre-aging the casting at a reduced temperature between about room temperature and about 100° C.; and aging the casting with at least one substantially isothermal aging at a temperature elevated to the reduced temperature subsequent to the pre-aging; wherein the mechanical property comprises at least one of strength, hardness, and toughness.

Optionally, the quenching temperature of the casting may be determined by at least one of computational thermodynamics, which may be defined by at least one of the aluminum alloy composition and a solidification condition, and experimental tests. For example, the quenching temperature for an A380 aluminum alloy composition and its variants may be between about 400° C. and about 450° C. The quenching of the casting generally occurs at an optimal quench media temperature and for an optimal quench time, the optimal quench media temperature and the optimal quench time determined by computational kinetics defined by at least one of the aluminum alloy composition and the quench media. The quench media generally comprises air, water, or organic additive solutions and, in one embodiment, the optimal media temperature of a water quench media is about 95° C. for an A380 aluminum alloy composition comprising a magnesium concentration that equals about 0.3% by weight of the A380 aluminum alloy composition.

Further, optionally, the method generally comprises removing the casting from the die with attainment of the quenching temperature prior to quenching the casting in the quench media. A length of time from the removing of the casting from the die to the quenching of the casting in the quench media generally does not exceed about 15 seconds.

The pre-aging may be performed simultaneously with the quenching in the quench media at the reduced temperature. In one embodiment, the reduced temperature of the pre-aging is between about 65° C. and about 95° C. The elevated temperature of the at least one substantially isothermal aging generally is between about 150° C. and about 240° C. and, more particularly, generally is between about 170° C. and 200° C. The aging of the casting in the at least one substantially isothermal aging may comprise aging the casting in a first isothermal aging at an elevated temperature of about 180° C.; and aging the casting in a second isothermal aging subsequent to the first isothermal aging at an elevated temperature of about 200° C. The aging of the casting in the second isothermal aging may further enhance at least one of the mechanical properties of the casting.

Further, optionally, the aluminum alloy composition may comprise a magnesium concentration greater than about 0.2% and less than about 0.55% by weight of the aluminum alloy composition. For example, the magnesium concentration may equal about 0.35% by weight of the aluminum alloy composition. The aluminum alloy composition may comprise a copper concentration greater than about 1.5% and less than about 5.0% by weight of the aluminum alloy composition. For example, the copper concentration may equal about 3.0% by weight of the aluminum alloy composition. The aluminum alloy composition may comprise a silicon concentration greater than about 0.5% and less than about 23% by weight of the aluminum alloy composition. For example, in one embodiment, the silicon concentration equals about 9.0% by weight of the aluminum alloy composition. The aluminum alloy composition may comprise a zinc concentration greater than about 0.3% and less than about 3.0% by weight of the aluminum alloy composition. For example, in one embodiment, the zinc concentration equals about 0.5% by weight of the aluminum alloy composition. Further, the aluminum alloy composition may comprise a magnesium concentration greater than about 0.2% by weight of the aluminum alloy composition; a copper concentration greater than about 1.5% by weight of the aluminum alloy composition; a silicon concentration greater than about 0.5% by weight of the aluminum alloy composition; and a zinc concentration greater than about 0.3% by weight of the aluminum alloy composition. More particularly, the magnesium concentration may equal about 0.35% by weight of the aluminum alloy composition; the copper concentration may equal about 3.0% by weight of the aluminum alloy composition; the silicon concentration may equal about 9.0% by weight of the aluminum alloy composition; and the zinc concentration may equal about 0.5% by weight of the aluminum alloy composition.

Further, optionally, the casting may be aged for lengths of time respective to the pre-aging and the isothermal agings with the respective lengths of time defined by the aluminum alloy composition. The method may further comprise selectively cooling one or more designated areas of the casting prior to removing the casting from the die for quenching. The selective cooling may be provided via at least one of a gating system, a venting system, a cooling system, and an application of water, die lubricant, or coolant gas spray. Further, the method may comprise cooling the casting to room temperature between the pre-aging and each of the at least one isothermal agings.

In accordance with another embodiment, a method of manufacturing an aluminum high pressure die casting comprises: forcing under high pressure a molten aluminum alloy composition into a die, wherein the aluminum alloy composition comprises a magnesium concentration greater than about 0.2% and less than about 0.55% by weight of the aluminum alloy composition, a copper concentration greater than about 1.5% and less than about 5.0% by weight of the aluminum alloy composition, a silicon concentration greater than about 0.5% and less than about 23.0% by weight of the aluminum alloy composition, and a zinc concentration greater than about 0.3% and less than about 3.0% by weight of the aluminum alloy composition; solidifying the aluminum alloy composition in the die to form the aluminum alloy high pressure die casting; cooling the casting in the die to a quenching temperature between about 400° C. and about 450° C., wherein the quenching temperature is determined by at least one of computational thermodynamics, defined by at least one of the composition of the aluminum alloy and a solidification condition, and experimental tests; quenching the casting in a quench media immediately upon attainment of the quenching temperature of the casting at an optimal quench media temperature and for an optimal quench time, wherein the optimal quench media temperature and the optimal quench time are determined by computational kinetics defined by at least one of the aluminum alloy composition and the quench media; pre-aging the casting at a reduced temperature between about room temperature and about 100° C.; and aging the casting in at least one substantially isothermal aging at an elevated temperature between about 170° C. and about 200° C. subsequent to the pre-aging.

In accordance with yet another embodiment, a method of enhancing a mechanical property of an aluminum alloy high pressure die casting comprises: formulating an aluminum alloy composition for formation of the aluminum alloy high pressure die casting, wherein the aluminum alloy composition comprises a magnesium concentration greater than about 0.2% and less than about 0.55% by weight of the aluminum alloy composition, a copper concentration greater than about 1.5% and less than about 5.0% by weight of the aluminum alloy composition, a silicon concentration greater than about 0.5% and less than about 23.0% by weight of the aluminum alloy composition, and a zinc concentration greater than about 0.3% and less than about 3.0% by weight of the aluminum alloy composition; forming the casting in a die from the aluminum alloy composition; removing the casting from the die with attainment of a quenching temperature of the casting between about 300° C. and about 500° C.; quenching the casting in a quench media immediately upon removal of the casting from the die; pre-aging the casting at a reduced temperature between about room temperature and about 100° C.; and aging the casting in at least one substantially isothermal aging at an elevated temperature between about 150° C. and about 240° C. subsequent to the pre-aging; wherein the mechanical property comprises at least one of strength, hardness, and toughness.

BRIEF DESCRIPTION OF THE DRAWINGS

The following detailed description of specific embodiments can be best understood when read in conjunction with the following drawings, where like structure is indicated with like reference numerals and in which.

Figure 1:
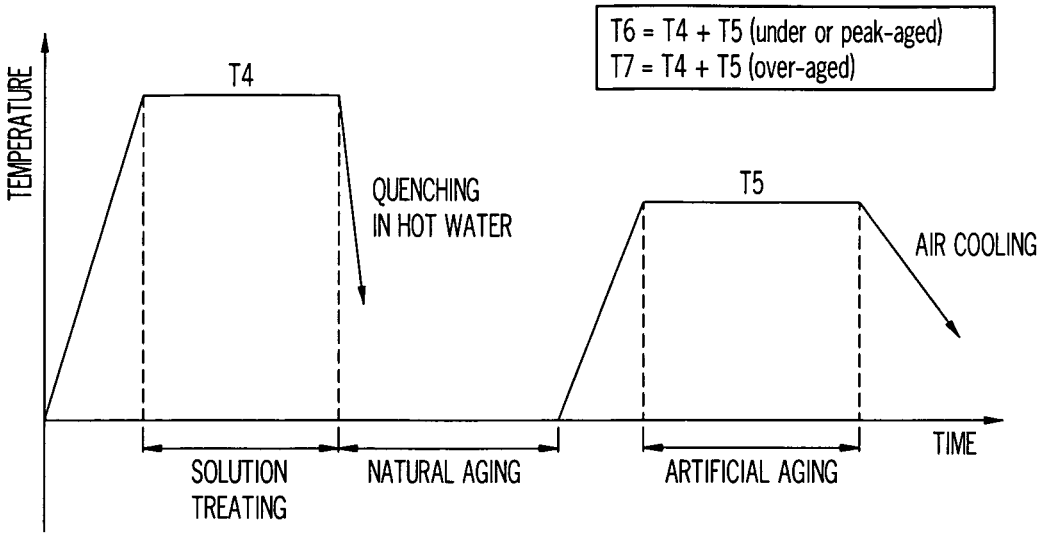
FIG. 1 (PRIOR ART)
FIG. 1 is a graphical illustration of conventional T6 and/or T7 heat treatment cycles of the prior art for an aluminum alloy.
Figure 2:
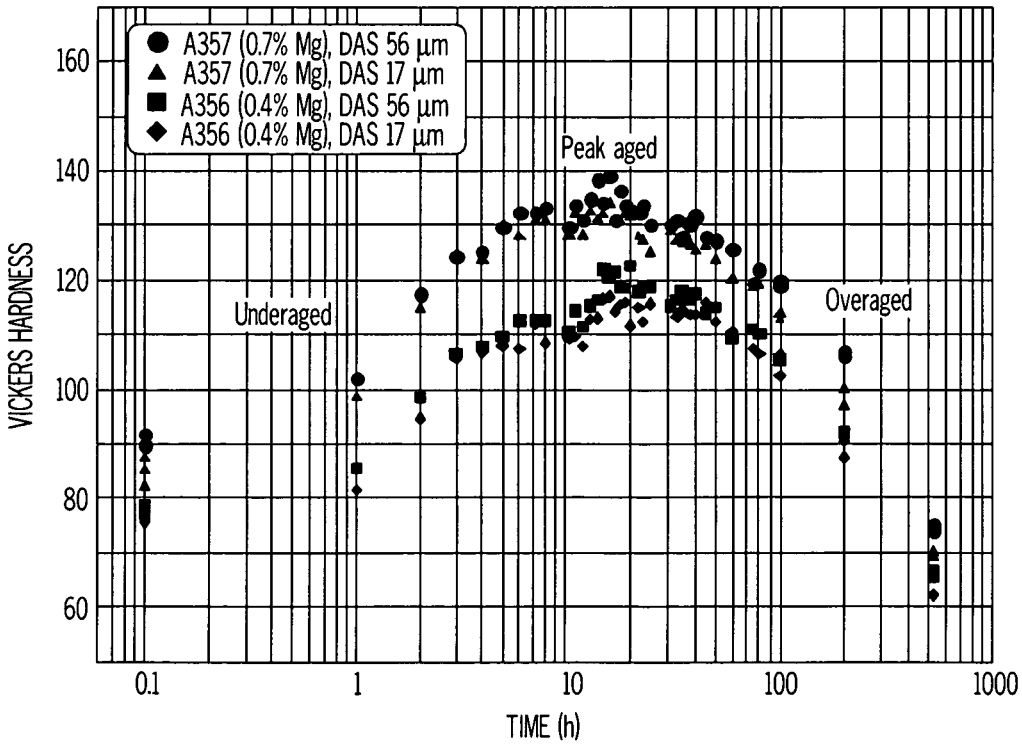
FIG. 2 (PRIOR ART)
FIG. 2 is a graphical illustration of aging responses of cast aluminum alloys A356/A357 aged at 170° C. according to the prior art.
Figure 3:
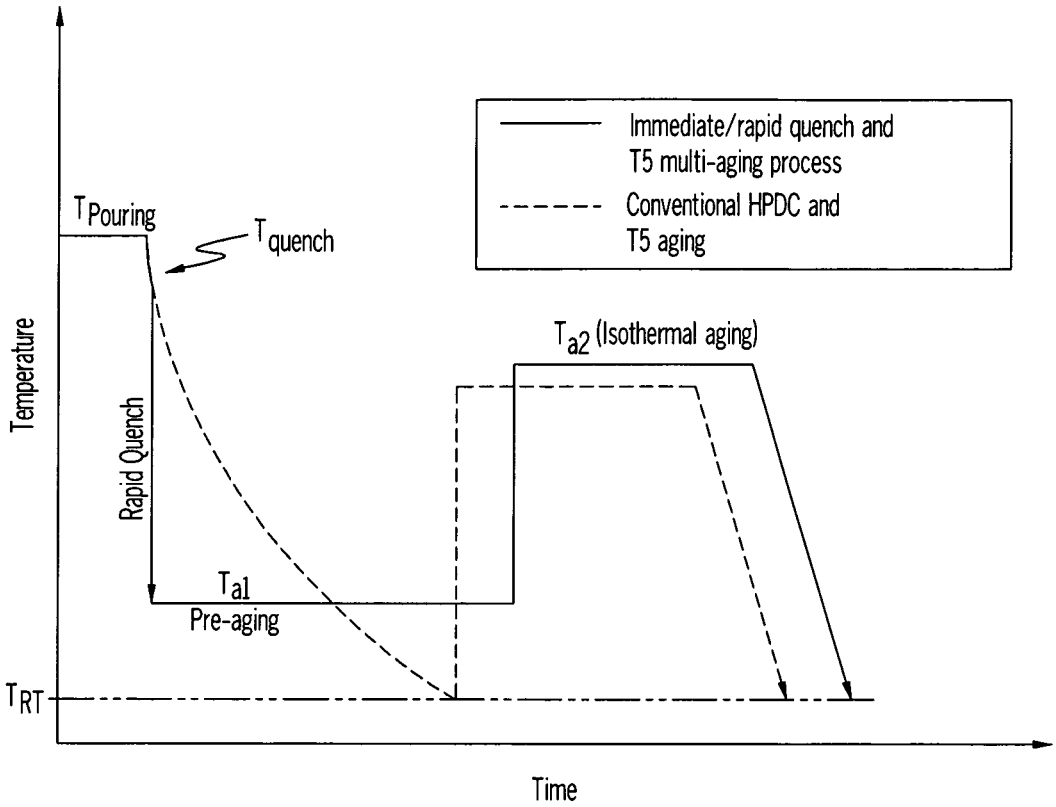
FIG. 3 is a graphical illustration of a method of enhancing the yield strength of an aluminum high pressure die casting according to one embodiment of the present invention.

The embodiments set forth in the drawings are illustrative in nature and are not intended to be limiting of the embodiments defined by the claims. Moreover, individual aspects of the drawings and the embodiments will be more fully apparent and understood in view of the detailed description that follows.

DETAILED DESCRIPTION

Embodiments relate generally to methods of enhancing mechanical properties of aluminum alloy high pressure die castings and to methods of manufacturing aluminum alloy high pressure die castings in both the high pressure die casting and the heat treatment processes. As used herein, "castings" refer generally to aluminum alloy high pressure die castings formed through solidification of aluminum alloy compositions. Thereby, the castings may be referred to herein during any stage of a high pressure die casting process and/or a heat treatment process subsequent to solidification, whether cooling, quenching, aging, or otherwise. Further, castings may include any part, component, product formed via an embodiment of the present invention.

Further, as used herein, "mechanical property," and related phrases thereof, refer generally to at least one and/or any combination of, strength, hardness, toughness, elasticity, plasticity, brittleness, and ductility and malleability that measures how a metal, such as aluminum and alloys thereof, behaves under a load. Mechanical properties generally are described in terms of the types of force or stress that the metal must withstand and how these are resisted.

As used herein, "strength" refers to at least one and/or any combination of yield strength, ultimate strength, tensile strength, fatigue strength, and impact strength. Strength refers generally to a property that enables a metal to resist deformation under a load. Yield strength refers generally to the stress at which a material begins to deform plastically. In engineering, the yield strength may be defined as the stress at which a predetermined amount (for instance about 0.2%) of permanent deformation occurs. Ultimate strength refers generally to a maximum strain a metal can withstand. Tensile strength refers generally to a measurement of a resistance to being pulled apart when placed in a tension load. Fatigue strength refers generally to an ability of a metal to resist various kinds of rapidly changing stresses and may be expressed by the magnitude of alternating stress for a specified number of cycles. Impact strength refers generally to the ability of a metal to resist suddenly applied loads. Generally, the higher the yield strength, the higher the other strengths are as well.

As used herein, "hardness" refers generally to a property of a metal to resist permanent indentation. Hardness generally is directly proportional to strength. Thus, a metal having a high strength also typically has high hardness.

Further, as used herein, "toughness" refers generally to a property that enables a metal to withstand shock and to be deformed without rupturing. Toughness may be considered to be a combination of strength and plasticity. Toughness generally, but not necessarily, increases with an increasing or increased strength.

Further, an application of a load to a metal may cause the metal to deform. As used herein, "elasticity" refers generally to a property that enables a metal to return to its original shape after the load is removed. Theoretically, an elastic limit of a metal is the limit to which the metal can be loaded and still recover its original shape after the load is removed. Typically, elasticity increases with an increase in strength.

Also, as used herein, "plasticity" refers generally to a property that enables a metal to deform permanently without breaking or rupturing. As such, plasticity may be considered as an opposite of strength. By careful alloying of metals, the combination of plasticity and strength may be used to manufacture large structural members. For example, should a member and/or a component of an automotive structure be overloaded, plasticity allows the overloaded member and/or component to deform plastically, thereby allowing the distribution of the load to other parts of the structure. Increased strength may slightly decrease a plasticity of an aluminum alloy casting including high pressure die casting.

Further, as used herein, "brittleness" refers generally to a property of a metal that is opposite the property of plasticity. A brittle metal is one that breaks or shatters before it deforms. Generally, brittle metals are high in compressive strength but low in tensile strength. Typically, brittleness increases with increases in strength.

In addition, as used herein, "ductility" refers generally to a property that enables a metal to stretch, bend, or twist without cracking or breaking. As such, ductility makes it possible for a metal to be drawn out into a thin wire. In comparison, as used herein, "malleability" refers generally to a property that enables a metal to deform by compressive forces without developing defects. As such, a malleable metal is one that can be stamped, hammered, forged, pressed, and/or rolled into thin sheets. Ductility and malleability generally are the opposite of strength. In aluminum alloy high pressure die castings, however, the ductility and malleability typically experience little decrease with an increase in strength since the metals generally already have low ductility and malleability.

For simplification purposes, while embodiments primarily are described herein as enhancing a strength, such as yield strength, of an aluminum alloy high pressure die casting, it is to be understood, that, as indicated above, the embodiments may enhance one or more other mechanical properties of the casting in addition to, or in the alternative of, strength.

Aluminum alloy compositions solidified to form castings comprise a number of elements, such as, but not limited to, aluminum (Al), silicon (Si), magnesium (Mg), copper (Cu), iron (Fe), manganese (Mn), zinc (Zn), nickel (Ni), titanium (Ti), strontium (Sr), etc. The elements and their respective concentrations that define an aluminum alloy composition may affect significantly the mechanical properties of the casting formed therefrom. More particularly, some elements may be referred to as hardening solutes. These hardening solutes may engage and/or bond among themselves and/or with other elements during solidification, cooling, quenching, and aging of casting and heat treatment processes. Aging generally is used to strengthen castings. While, various processes for aging are available, generally only some are applicable and/or sufficiently effective for aluminum alloy high pressure die casting processes, for reasons described above. Therefore, as used herein, "aging," and terms and phrases thereof, refer generally to T5 aging (natural or artificial). Aging strengthens castings by facilitating the precipitation of the hardening solutes of the aluminum alloy composition.

More particularly, artificial aging (T5) heats the castings to an elevated, typically intermediate, temperature for a length of time sufficient to strengthen the casting through precipitation of the hardening solutes. Since precipitation is a kinetic process, the respective concentrations (supersaturation) of the hardening solutes available for precipitation are significant to the casting's strengthening response to aging. Therefore, the concentrations of hardening solutes, and the availability thereof for precipitation, significantly impact the extent to which the casting is strengthened during aging. If the hardening solutes are prevented, or substantially prevented, from bonding among themselves and/or with other elements prior to the aging, then the hardening solutes may precipitate during aging to strengthen the casting.

To prevent, or at least substantially prevent, the hardening solutes from bonding among themselves and/or with other elements of the aluminum alloy composition prior to aging and, thereby, maintain the availability of the hardening solutes, the casting is cooled to a quenching temperature in the die and quenched immediately thereafter. To facilitate the cooling of the casting to the quenching temperature, an embodiment may comprise selectively heating and/or cooling one or more designated areas of the casting prior to its removal from the die for quenching. The selective heating and/or cooling may be provided via at least one of a gating system, a venting system, a cooling system, and an application of water, die lubricant, or coolant gas spray. For example, locally enhanced cooling may be accomplished by providing or optimizing a cooling system in the die and/or by applying water, a die lubricant, or a coolant gas spray before and/or after die opening. The selective heating and/or cooling may minimize the potential for distortion of the casting and may be provided to the casting at designated areas of the casting that may cool more or less quickly than other areas of the casting. Those designated areas generally are those that have less mechanical property requirements. For example, the biscuit and other gating areas usually solidify last and, thus, the cooling of those areas should be enhanced in order to be able to quickly remove the casting from the die after the casting is solidified.

Quenching of castings immediately upon removal from dies at defined quenching temperatures has been found to retain maximum, or at least significant, concentrations of hardening solutes available for precipitation during aging, thereby, enhancing the mechanical properties of the castings. Generally, the quenching temperatures of the castings and the length of time between removal from the dies and quenching significantly influence the castings' degrees of supersaturation of hardening solutes for precipitation. More particularly, quenching temperatures of the castings determine the respective concentrations of hardening solutes freely available (i.e., not engaged or otherwise bound) to precipitate in the casting. The higher the quenching temperature, the greater the solubility and the resultant concentrations of available hardening solutes in the casting for subsequent aging.

Figure 4:
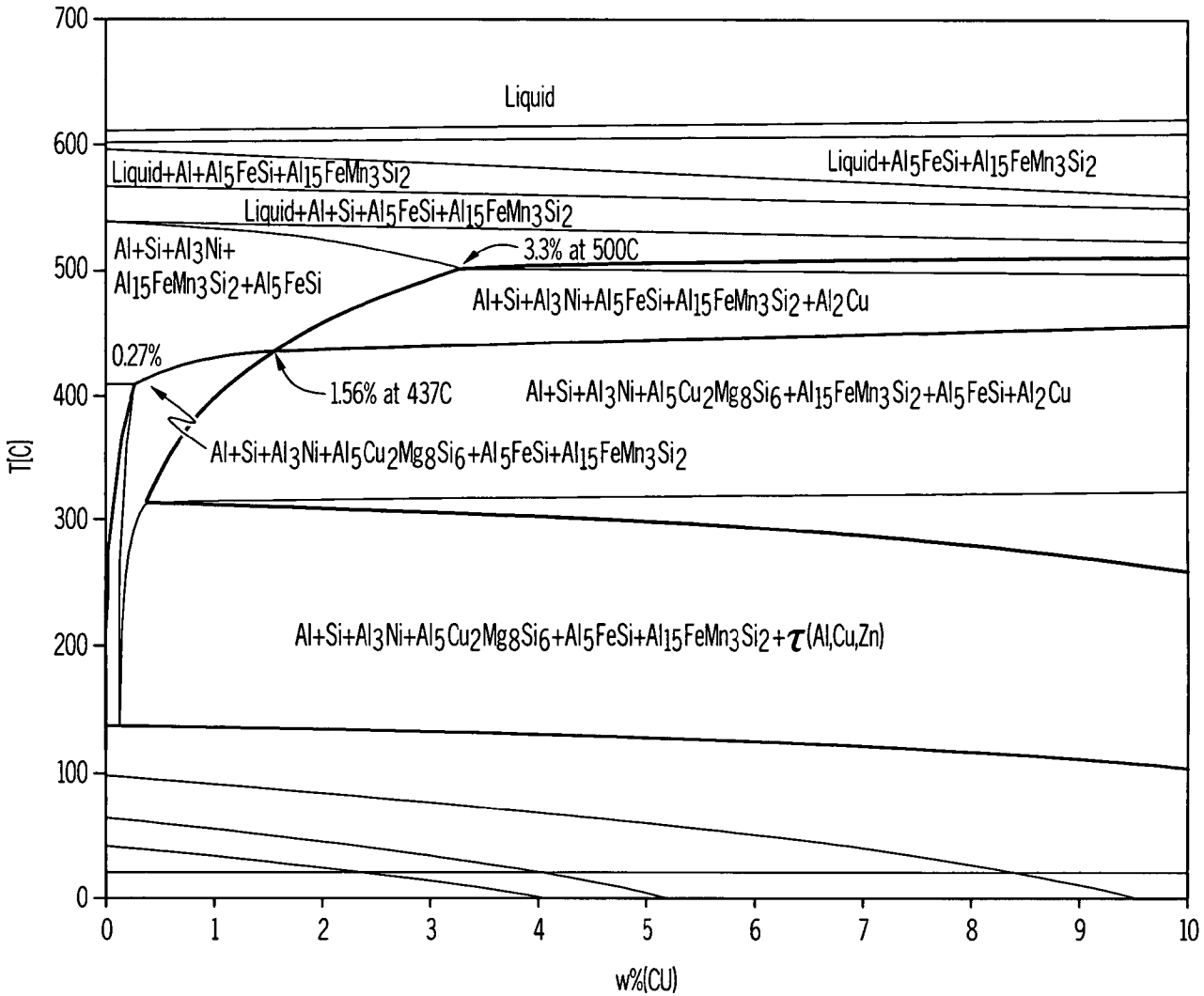
FIG. 4 is a graphical illustration of phase transformations of an aluminum high pressure die casting as a function of Cu concentrations according to another embodiment of the present invention.
Figure 5:
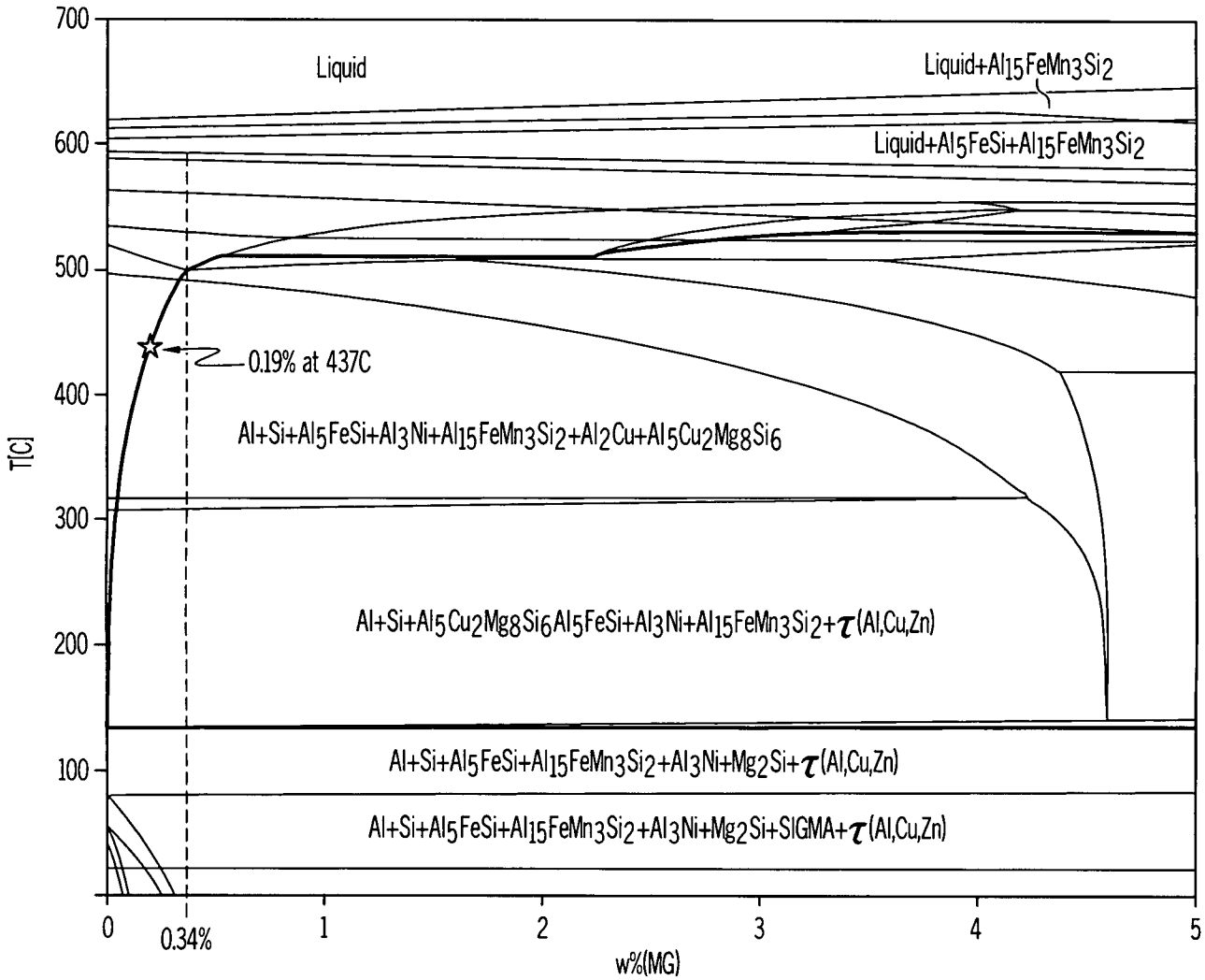
FIG. 5 is a graphical illustration of phase transformations of an aluminum high pressure die casting as a function of Mg concentrations according to another embodiment of the present invention.

In high pressure die casting practices, the quenching temperatures of castings are dependent upon the time and/or temperature at which the die opens and how the castings are removed from the dies and quenched. The time to remove the castings from dies and quench them in the quench media typically depends on the aluminum alloy composition and the thermal transfer of metal dies in the high pressure die casting machine. Theoretically, the castings can be removed from the dies at the time when the quenching temperature is close to the solidus of the alloy. For conventional high pressure die casting aluminum alloys, and their variants, for instance, the quenching temperature can be as high as 500° C. at which all liquid of the aluminum alloy is solidified based on phase equilibrium (See FIGS. 4 and 5). When the quenching temperature is too high, however, a high residual stress and severe distortion can be expected in the finish castings. In addition, the actual solidus during casting processes, particularly in high pressure die casting processes, can be substantially lower than that in equilibrium solidification condition since a high cooling rate during solidification can significantly suppress the solidus.

Figure 6:
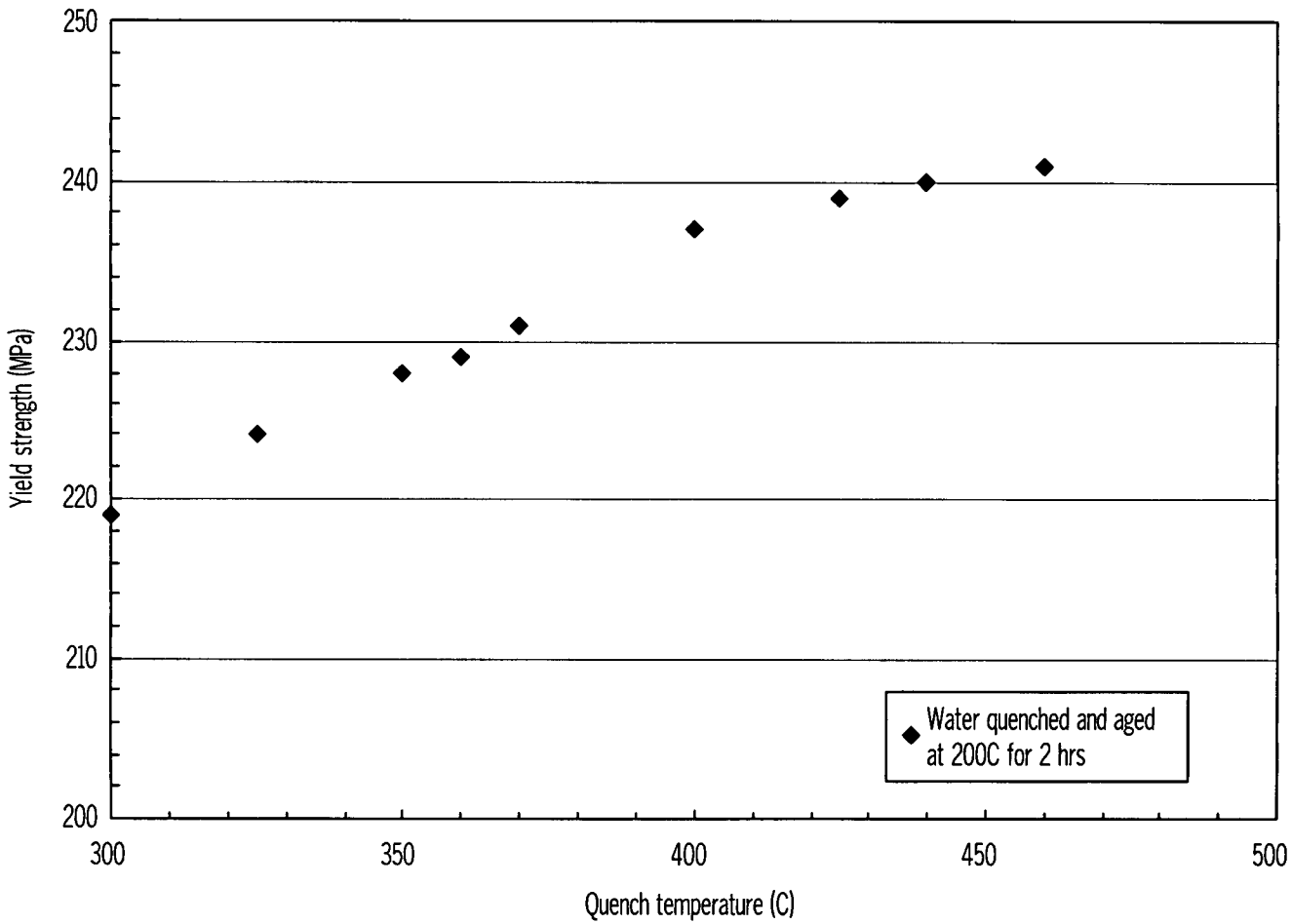
FIG. 6 is a graphical illustration of yield strength of an aluminum high pressure die casting as a function of quenching temperature according to another embodiment of the present invention.

In the embodiments, however, ranges of quenching temperatures are determined by computational thermodynamic and/or kinetic calculations defined by the specific aluminum alloy composition and/or experimental tests. As such, the quenching temperature to which the casting is cooled generally is optimal for the specific alloy being cast. Once the quenching temperature is attained, the casting is removed from the die and immediately quenched in a quench media. Generally, for common aluminum alloy high pressure die castings, such as, but not limited to, A380 and its variants, the quenching temperature range is between about 300° C. and about 500° C. and, more particularly, may be between about 400° C. and about 500° C. and, even more particularly, may be between about 400° C. and about 450° C. FIG. 6 graphically illustrates the influence of quench temperature on the yield strength of an A380 aluminum high pressure die casting cast in a metal permanent mold. The dramatic increase of yield strength from quench temperature of 300° C. to 400° C. and higher is attributed to a significant increase of retained concentrations of solutes available for precipitation strengthening.

Further, to increase precipitation during aging, and, thereby, enhance mechanical properties of castings, one or more specific hardening solutes may be incorporated into the aluminum alloy composition. More particularly, some hardening solutes are more effective in strengthening castings than others. Magnesium (Mg), copper (Cu), and silicon (Si), for example, tend to be highly effective hardening solutes in aluminum alloys. Mg may combine with Si to form Mg/Si precipitates, such as β", β', and equilibrium $Mg_2Si$ phases. The precipitate types, sizes, and concentrations typically depend on the present aging conditions and the compositions of the aluminum alloys. For example, under-aging tends to form shearable β" precipitates, while peak-aging and over-aging generally form unshearable β' and equilibrium $Mg_2Si$ phases. When aging aluminum alloys, Si alone can form Si precipitates. Si precipitates, however, generally are not as effective as Mg/Si precipitates in strengthening aluminum alloys. Further, Cu can combine with aluminum (Al) to form multiple metastable precipitate phases, such as θ' and θ, in Al—Si—Mg—Cu alloys, which tend to be very effective in strengthening.

Furthermore, increased concentrations of such more effective hardening solutes may be incorporated into the aluminum alloy composition to increase their availability for precipitation at aging. According to specifications for conventional aluminum alloy compositions for high pressure die castings, generally the maximum Mg concentration incorporated is less than 0.1% by weight of the respective compositions. In industry practice, however, the Mg concentrations in such aluminum alloy compositions tend to be much lower than 0.1%. As a result, the compositions generally have an inability to form Mg/Si precipitates and, as such, minimal strengthening of the casting through Mg/Si precipitation results, even during T5 aging processes. In fact, generally, the only feasible strengthening of the casting in this case results through formation of Al/Cu precipitates. Under conventional high pressure die casting practices, however, the strengthening from Al/Cu precipitation is limited as well.

Calculations derived from computational thermodynamics (FIG. 4) indicate that Al/Cu precipitation tends to be limited under conventional high pressure die casting practices due to extremely low (e.g., approximating 0% by weight) Cu concentrations available for precipitation during aging, particularly when castings are cooled slowly after solidification under conventional processes, as opposed to the immediate quenching taught in the embodiments. While high Cu concentrations (e.g., about 3.0%) may be incorporated in aluminum alloy compositions for conventional HPDC alloys, a majority of the Cu concentration typically forms inter-metallic phases with iron (Fe) and other elements during solidification of the composition and the subsequent slow cooling process. These inter-metallic phases generally provide no meaningful response, such as strengthening, to aging if the castings do not undergo high temperature solution treatments (T4) to free Cu solutes by dissolving the Cu-rich intermetallics.

Figure 7:
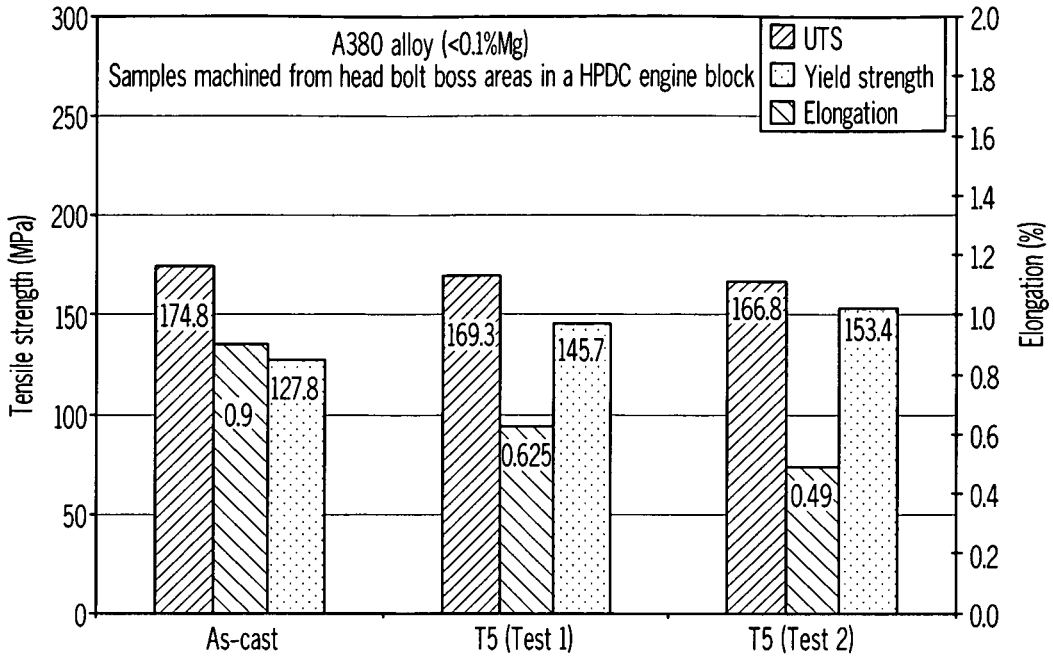
FIG. 7 (PRIOR ART)
FIG. 7 is a graphical illustration of the effect of Mg concentrations and T5 aging on the tensile properties of an aluminum high pressure die casting (comprising less than about 0.10% Mg) according to the prior art.
Figure 8:
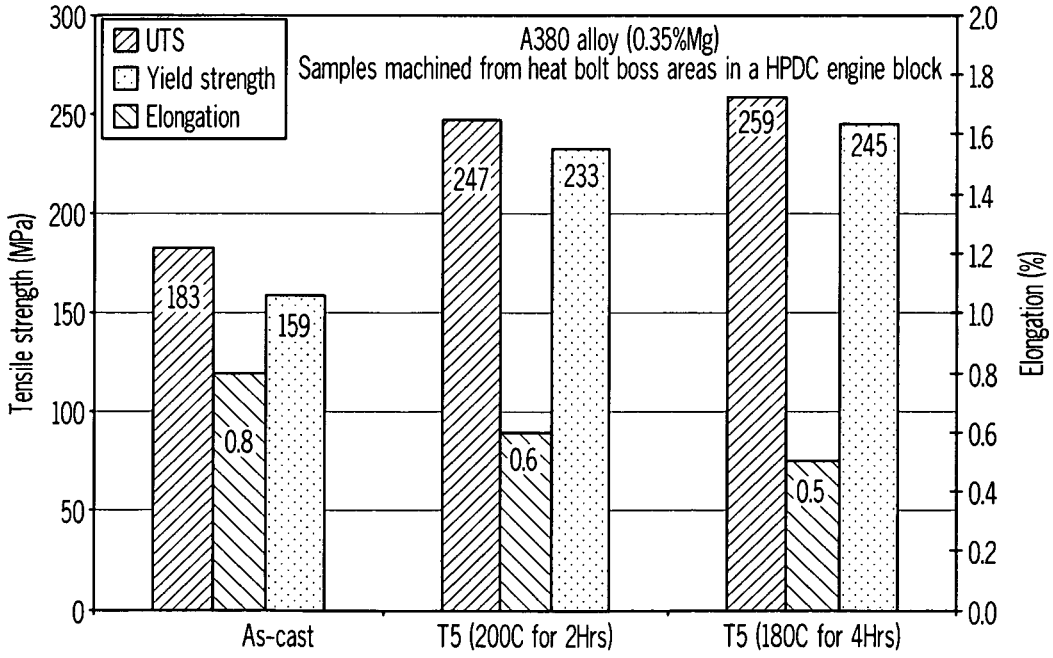
FIG. 8 is a graphical illustration of the effect of Mg concentrations and T5 aging on the tensile properties of an aluminum high pressure die casting (comprising about 0.35% Mg) according to another embodiment of the present invention.

Thus, to enhance precipitation of hardening solutes, and, thus, mechanical properties, during aging of castings, respective concentrations thereof in aluminum alloy compositions may be increased relative to conventional concentration levels. More particularly, respective concentrations of at least one of Mg, Cu, Si, and Zn may be increased to enhance precipitation thereof during aging of the castings. The embodiments contemplate that the aluminum alloy compositions comprise at least one of Mg, Cu, Si, and Zn. The Mg concentration, if incorporated into the composition, generally is greater than about 0.2% and less than about 0.55%, and may equal about 0.35%, by weight of the composition. The Cu concentration, if incorporated into the composition, generally is greater than about 1.5% and less than about 5.0%, and may equal about 3.0%, by weight of the composition. The Si concentration, if incorporated into the composition, generally is greater than about 0.5% and less than about 23.0%, and may equal about 9.0%, by weight of the composition. The Zn concentration, if incorporated into the composition, generally is greater than about 0.3% and less than about 3.0%, and may equal about 0.5%, by weight of the composition. In one embodiment, the aluminum alloy composition comprises Mg, Cu, Si, and Zn in any combination of the above respective concentrations. Increasing at least one of the respective concentrations of Mg, Cu, Si, and Zn in an aluminum alloy composition as described above may significantly enhance mechanical properties of the casting. For example, FIGS. 7 and 8 graphically illustrate significantly higher tensile properties of castings and of tensile specimens due to increases in Mg concentration over the conventional concentration specification of about 0.1%.

As mentioned above, once the quenching temperature for the casting is attained, the casting is removed from the die and immediately quenched in a quench media to retain maximum, or at least significant, respective concentrations of the hardening solutes available for precipitation during aging. Thus, the transition of the casting into the quench media should be immediate, or as quickly as possible, to minimize any further slow cooling of the casting once it is removed from the die. As used herein, "immediate," and terms thereof, refers generally to occurring without delay and/or with a minimal lapse of time. For example, a length of time from removing the casting from the die to the quenching of the casting in the quench media should not exceed about 15 seconds. To minimize a length of time between removal from the die and quenching, the quench media may be arranged below or next to the high pressure die casting machine.

The quenching of the casting generally occurs at an optimal quench media temperature for an optimal quench time. The optimal quench media temperature and the optimal quench time generally are determined by computational kinetics defined by the specific aluminum alloy being cast. The quench media generally comprises air, water, or other organic additive solutions. In one embodiment, the optimal media temperature of a water quench media is between about 65° C. and about 95° C. This quench media temperature is generally lower than those of conventional quenching practices. The lower quench media temperature increases the cooling rate of the casting and facilitates the entrapment of the solutes in solution. It should be noted, however, that the low quench media temperature may increase residual stress in the quenched parts.

Following quenching, the casting is aged for strengthening purposes, as described above. Aging facilitates formation of GP zones and coherent and incoherent precipitates of hardening solutes, which generally corresponds to nucleation, growth, and coarsening of precipitates. Embodiments of the present invention pre-age the castings at reduced temperatures and, subsequent to the pre-age, isothermally, or substantially isothermally, age the castings at temperatures elevated to the reduced temperatures. Thereby, the aging schemes of embodiments of the present invention maximize, or at least significantly increase, the number density of vacancies and, in particular, to initiate formation of increased numbers of GP zones in the as-quenched castings.

The embodiments utilize pre-aging to generate additional GP zones and fine precipitate nuclei. Generally, the variation of the precipitate density (number of precipitates by unit volume) is directly related to nucleation rate, which is dependent upon aging temperature (T) and time (t).

$$\frac{\partial N}{\partial t} = f(T, t) \tag{1}$$

where N is the precipitate density.

Figure 9:
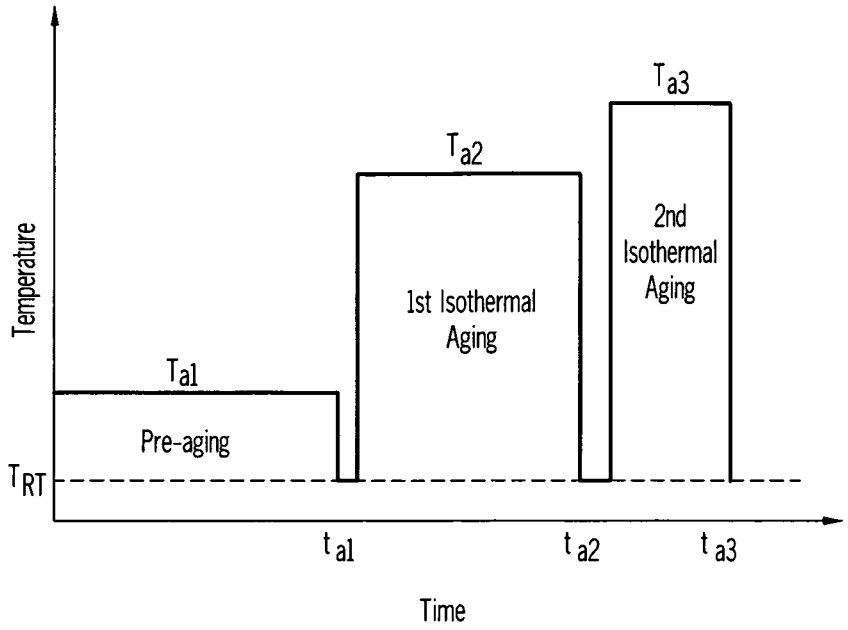
FIG. 9 is a graphical illustration of a method of enhancing the yield strength of an aluminum high pressure die casting according to another embodiment of the present invention.

The pre-aging may be performed in the quench media at the reduced temperature. As such, following quenching, or contemporaneously therewith, the casting may remain in the quench media for pre-aging with modification of, if and as necessary, the temperature of the quench media to the reduced temperature. For example, when using a water quench media, pre-aging may be performed by retaining castings in the (warm) water for a length of time after quench. The present inventors contemplate, however, that the castings may be pre-aged in room temperature (e.g., about 25° C.), warm air, or other ovens or furnaces following quenching in water or other quench media. Further, the present inventors contemplate that the isothermal aging may comprise multiple stages at elevated temperatures and may be performed subsequently to the pre-aging. For example, in one embodiment, the isothermal aging comprises aging the casting in a first isothermal aging at an elevated temperature subsequent to the pre-aging and aging the casting in a second isothermal aging subsequent to the first isothermal aging at a temperature elevated to the elevated temperature of the first isothermal aging. Generally, the second isothermal aging further enhances the yield strength of the casting. FIG. 9 schematically illustrates an embodiment of a three-step aging scheme. It should be noted that the castings are not necessarily cooled to room temperature between agings. Rather, the method may comprise a continuous transition between the pre-aging and each of the at least one isothermal agings without cooling the casting to room temperature between the pre-aging and each of the at least one isothermal agings. As used herein, "reduced temperature" refers generally to a temperature reduced relative to a quenching temperature of a casting, while, as used herein, "elevated temperature" refers generally to a temperature elevated relative to the reduced temperature.

Figure 10:
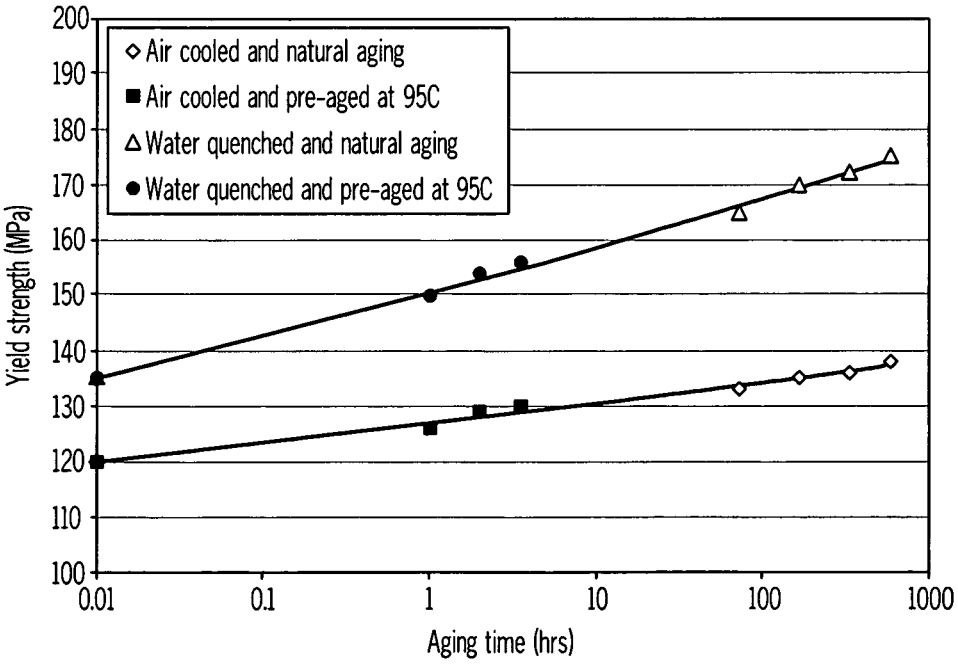
FIG. 10 is a graphical illustration of comparisons of pre-aging responses of an aluminum high pressure die casting in both water quench media and air quench media according to one embodiment of the present invention.

The respective aging temperatures and aging times for the pre-aging and the isothermal aging(s) generally depend on the aluminum alloy compositions and productivity requirements. As the nucleation and formation of GP zones and/or fine precipitates is a kinetic process, a longer aging time generally is expected for lower aging temperature. If the castings are naturally aged at room-temperature, for instance, the aging time can be as long as several days or even a couple of weeks. For example, FIG. 10 compares aging responses of tensile specimens (12.85 mm in diameter) of A380 HPDC alloy cast in a permanent die and pre-aged at room temperature and 95° C.

The reduced temperature of the pre-aging generally is between about room temperature and about 100° C. and, more particularly, may be between about 70° C. about 95° C. Meanwhile, the elevated temperature of the isothermal aging generally is between about 150° C. and about 240° C. and, more particularly, may be between about 170° C. and about 200° C. For example, in one embodiment, the elevated temperature for a first isothermal aging is about 180° C. and the elevated temperature for a second isothermal aging is about 200° C. If high productivity and/or short aging time are required, generally a high aging temperature, such as 200° C., is utilized during isothermal aging. Otherwise, a slightly lower aging temperature, such as 180° C., may further enhance mechanical properties of castings. For example, but not by way of limitation, the yield strength of an A380 aluminum alloy casting may be significantly enhanced by pre-aging at about 95° C. for about 2.5 hours, followed by a first isothermal aging at about 180° C. for about 4.0 hours, followed by a second isothermal aging at about 200° C. for about 1.0 hour.

Generally, the lower the aging temperature, the longer the aging time necessary to maximize, or substantially maximize, enhancement of the mechanical properties of the castings. For example, a casting pre-aged at about 95° C. may substantially maximize enhancement of mechanical properties in about 2 hours to about 5 hours, while a casting pre-aged at room temperature may substantially maximize enhancement of mechanical properties in about 7 days. Further, by way of another example, a casting substantially isothermally aged at about 200° C. may substantially maximize enhancement of mechanical properties in about 2 hours, while a casting substantially isothermally aged at 180° C. may substantially maximize enhancement of mechanical properties in about 4 hours.

Further, as described above, with the embodiments, mechanical properties, such as tensile strength, of castings can be significantly enhanced. The enhanced mechanical properties of castings extend their acceptance and use in critical structural applications, such as, but not limited to, engine blocks, cylinder heads, transmission cases, and suspension components. In addition, the enhanced mechanical properties may significantly reduce warranty costs of castings in automotive applications.

Figure 11:
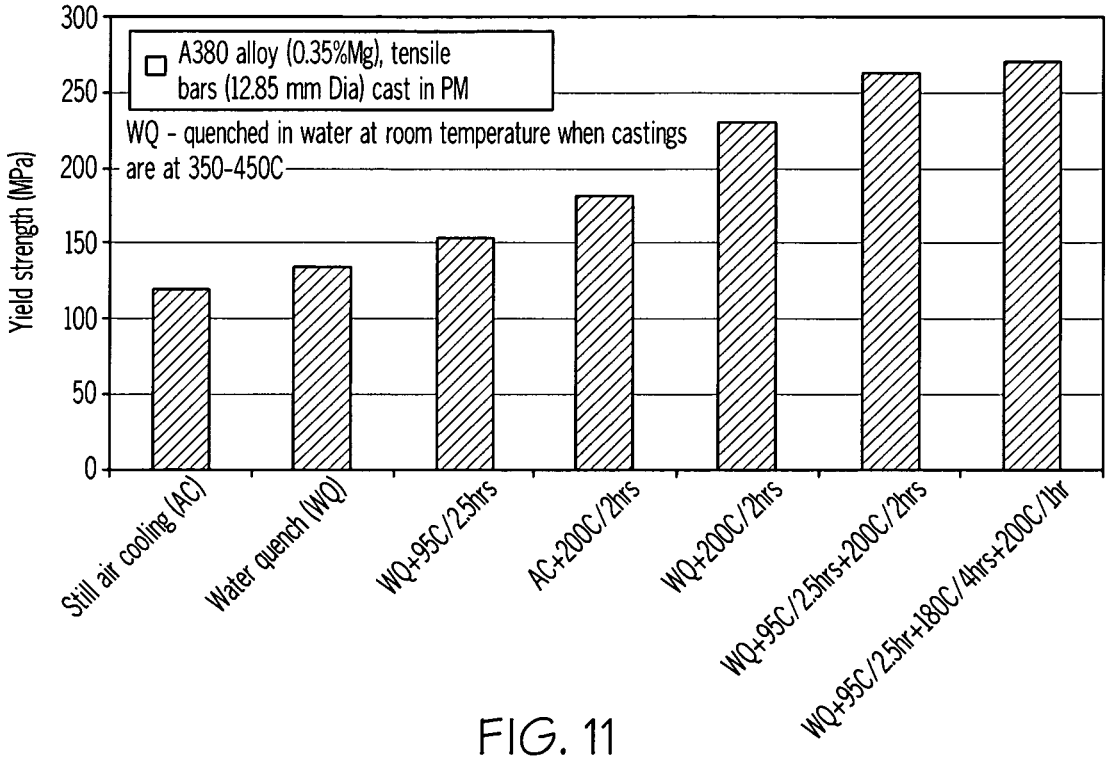
FIG. 11 is a graphical illustration of the enhancement of yield strength of an aluminum high pressure die casting according to various embodiments of the present invention.

Further, in comparison with tensile properties of castings in an as-cast state, the yield strength can be enhanced by about 50% or greater. FIG. 11 presents experimental results of the agings cycles and the immediate quench concept for a casting comprising a Mg concentration of about 0.35% by weight of the aluminum alloy composition from which the casting is formed when cast in a permanent die. Embodiments of the present invention establish that the yield strength, and/or other mechanical properties, can be enhanced significantly and steadily by implementing the methods and/or techniques described herein on a one by one basis. For example, quenching castings immediately after removal from the dies can increase the yield strength by at least about 10% in an as-cast state and about 25% when aged at about 200° C. for about 2 hours. Further, with performance of additional aging, the yield strength of castings can be increased by at least about 50%.

In accordance with one embodiment, a method of manufacturing an aluminum high pressure die casting comprises forcing under high pressure a molten aluminum alloy composition into a die typically having mold cavities. The aluminum alloy composition comprises a magnesium concentration equal to about 0.35% by weight of the aluminum alloy composition, a copper concentration equal to about 3.0% by weight of the aluminum alloy composition, a silicon concentration equal to about 9.0% by weight of the aluminum alloy composition, and a zinc concentration equal to about 0.5% by weight of the aluminum alloy composition. The molten aluminum alloy with a designated composition is solidified, or at least substantially solidified, in the die to form the aluminum alloy high pressure die casting. The casting is cooled in the die to a quenching temperature between about 400° C. and about 450° C. The quenching temperature is determined by at least one of computational thermodynamics, defined by the aluminum alloy composition and a solidification condition, and experimental tests. The casting then is quenched in a water quench media immediately upon attainment of the quenching temperature of the casting. The casting is quenched in the water quench media having an optimal quench media temperature of about 95° C. and for an optimal quench time, for example, of about 30 minutes. The optimal quench media temperature and the optimal quench time are determined by computational kinetics defined by at least one of the aluminum alloy composition and the quench media. It also is contemplated that at least one of the optimal quench media temperature and the optimal quench time may be determined by experimental tests. Following quenching, the casting is pre-aged at a reduced temperature of about 95° C. for about 2.5 hours. The casting subsequently is aged in a first substantially isothermal aging at an elevated temperature of about 180° C. for about 4 hours. The casting then is aged in a second substantially isothermal aging at about 200° C. for about 1 hour. The casting cast and heat treated via this method comprises, for example, a yield strength significantly enhanced, such as by 50% or greater, than castings formed via conventional methods.

While the methods described herein are specific in application to high pressure die castings, the present inventors contemplate that the methods, specifically the step involving the immediate quenching of the casting with attainment of a quenching temperature may be applicable to castings manufactured through other casting processes utilizing only aging, and not solution treatment, to strengthen the castings. In addition, the present inventors contemplate that the methods, specifically the steps involving the pre-aging of the casting at a reduced temperature between about room temperature and about 100° C. and the aging of the casting with at least one substantially isothermal aging at a temperature elevated to the reduced temperature subsequent to the pre-aging, may be applicable to castings manufactured through various casting processes other than high pressure die casting processes.

It is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural factors of the component.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially," "significantly, " and "approximately" are utilized herein to represent the inherent degree of uncertainty that may be attributed to any quantitative comparison, value, measurement, or other representation. The terms "substantially," "significantly," and "approximately" are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed is:

1. A method of enhancing a mechanical property of an aluminum alloy high pressure die casting that contains internal porosity, the method comprising:

forcing under high pressure a molten aluminum alloy composition into a die, wherein the aluminum alloy composition comprises at least one of magnesium, copper, silicon and zinc;

solidifying the aluminum alloy composition in the die to form the aluminum alloy high pressure die casting without the use of vacuum to remove air in mold cavities during die filling such that the solidified aluminum alloy high pressure die casting retains an internal porosity;

cooling the casting in the die to a quenching temperature between about 300° C. and about 500° C.;

quenching the casting in a quench media immediately upon attainment of the quenching temperature of the casting; and subjecting the casting to a multi-step aging process after the casting has been quenched, the multi-step aging process comprising:

pre-aging the casting at a reduced temperature between about room temperature and about 100° C. for between about two to five hours; and aging the casting with at least one substantially isothermal aging at a temperature greater than the reduced temperature, the aging taking place subsequent to the pre-aging, wherein the mechanical property comprises at least one of strength, hardness, and toughness.

2. The method of claim 1, wherein the quenching temperature of the casting is between about 400° C. and about 450° C.

3. The method of claim 1, wherein the quench media comprises air, water, or organic additive solutions.

4. The method of claim 3, wherein the temperature of the water quench media is between about 65° C. and about 95° C.

5. The method of claim 1, wherein a length of time from the removing of the casting from the die to the quenching of the casting in the quench media does not exceed about 15 seconds.

6. The method of claim 1, wherein the pre-aging is performed in the quench media at the reduced temperature.

7. The method of claim 1, wherein the reduced temperature of the pre-aging is between about 70° C. and about 95° C.

8. The method of claim 1, wherein the elevated temperature of the at least one substantially isothermal aging is between about 150° C. and about 240° C.

9. The method of claim 8, wherein the elevated temperature of the at least one substantially isothermal aging is between about 170° C. and 200° C.

10. The method of claim 1, wherein the aging of the casting in the at least one substantially isothermal aging comprises:

aging the casting in a first substantially isothermal aging at an elevated temperature of about 180° C.; and aging the casting in a second substantially isothermal aging subsequent to the first substantially isothermal aging at an elevated temperature of about 200° C.

11. The method of claim 1, wherein the aluminum alloy composition comprises a magnesium concentration greater than about 0.2% and less then about 0.55% by weight of the aluminum alloy composition.

12. The method of claim 11, wherein the magnesium concentration equals about 0.35% by weight of the aluminum alloy composition.

13. The method of claim 1, wherein the aluminum alloy composition comprises a copper concentration greater than about 1.5% and less than about 5.0% by weight of the aluminum alloy composition.

14. The method of claim 13, wherein the copper concentration equals about 3.0% by weight of the aluminum alloy composition.

15. The method of claim 1, wherein the aluminum alloy comprises a silicon concentration greater than about 0.5% and less than about 23.0% by weight of the aluminum alloy composition.

16. The method of claim 15, wherein the silicon concentration equals about 9.0% by weight of the aluminum alloy composition.

17. The method of claim 1, wherein the aluminum alloy comprises a zinc concentration greater than about 0.3% and less than about 3.0% by weight of the aluminum alloy composition.

18. The method of claim 17, wherein the zinc concentration equals about 0.5% by weight of the aluminum alloy composition.

19. The method of claim 1, wherein the aluminum alloy composition comprises:

a magnesium concentration greater than about 0.2% and less than about 0.55% by weight of the aluminum alloy composition;

a copper concentration greater than about 1.5% and less than about 5.0% by weight of the aluminum alloy composition; and a silicon concentration greater than about 0.5% and less than about 23.0% by weight of the aluminum alloy composition;

a zinc concentration greater than about 0.3% and less than about 3.0% by weight of the aluminum alloy composition.

20. The method of claim 19, wherein:

the magnesium concentration equals about 0.35% by weight of the aluminum alloy composition;

the copper concentration equals about 3.0% by weight of the aluminum alloy composition;

the silicon concentration equals about 9.0% by weight of the aluminum alloy composition; and the zinc concentration equals about 0.5% by weight of the aluminum alloy composition.

21. The method of claim 1, wherein the method further comprises selectively cooling one or more designated areas of the casting prior to removing the casting from the die for quenching.

22. The method of claim 1, wherein the method comprises cooling the casting to room temperature between the pre-aging and each of the at least one isothermal agings.

23. The method of claim 1, wherein the method comprises a continuous transition between the pre-aging and each of the at least one isothermal agings without cooling the casting to room temperature between the pre-aging and each of the at least one isothermal agings.

24. A method of enhancing a mechanical property of an aluminum alloy high pressure die casting that contains internal porosity, the method comprising:

formulating an aluminum alloy composition for formation of the aluminum alloy high pressure die casting, wherein the aluminum alloy composition comprises a magnesium concentration greater than about 0.2% by weight of the aluminum alloy composition, a copper concentration greater than about 1.5% by weight of the aluminum alloy composition, a silicon concentration greater than about 0.5by weight of the aluminum alloy composition, a zinc concentration greater than about 0.3% by weight of the aluminum alloy composition;

forming the casting in a die from the aluminum alloy composition;

removing the casting from the die with attainment of a quenching temperature of the casting between about 300° C. and about 500° C., the casting possessing an internal porosity without using a vacuum to remove air in mold cavities during die filling;

quenching the casting in a quench media immediately upon removal of the casting from the die;

subjecting the casting to a multi-step aging process after the casting has been quenched, the multi-step aging process comprising:

pre-aging the casting at a reduced temperature between about room temperature and about 100° C. for between about two to five hours; and aging the casting in at least one substantially isothermal aging at an elevated temperature between about 150° C. and about240° C., the aging taking place subsequent to the pre-aging, wherein the mechanical property comprises at least one of strength, hardness, and toughness.

25. A method of manufacturing an aluminum alloy high pressure die casting that contains internal porosity, the method comprising:

forcing under high pressure a molten aluminum alloy composition into a die, wherein the aluminum alloy composition comprises a magnesium concentration greater than about 0.2% by weight of the aluminum alloy composition, a copper concentration greater than about 1.5% by weight of the aluminum alloy composition, a silicon concentration greater than about 0.5% by weight of the aluminum alloy composition, a zinc concentration greater than about 0.3% by weight of the aluminum alloy composition;

solidifying the aluminum alloy composition in the die to form the aluminum alloy high pressure die casting without the use of vacuum to remove air in mold cavities during die filling such that the solidified aluminum alloy high pressure die casting retains an internal porosity;

cooling the casting in the die to a quenching temperature between about 300° C. and about 500° C., quenching the casting in a quench media immediately upon attainment of the quenching temperature of the casting; and subjecting the casting to a multi-step aging process after the casting has been quenched, the multi-step aging process comprising:

pre-aging the casting at a reduced temperature between about room temperature and about 100° C. for about 2.5 hours; and aging the casting in at least one substantially isothermal aging at an elevated temperature between about 150° C. and about240° C., the aging taking place subsequent to the pre-aging.

* * * * *